United States Patent [19]

Ishii et al.

[11] Patent Number: 4,863,511

[45] Date of Patent: Sep. 5, 1989

[54] METHOD OF FORMING A RARE EARTH-COBALT TYPE MAGNETIC POWDER FOR RESINOUS MAGNET

[76] Inventors: Junichi Ishii, 286, Ohmori-cho, Chiba City, Chiba Prefecture; Kouichi Oka, 3-18-35, Nakakokubun, Ichikawa City, Chiba Prefecture, both of Japan

[21] Appl. No.: 205,525

[22] Filed: Jun. 13, 1988

Related U.S. Application Data

[60] Division of Ser. No. 16,887, Feb. 20, 1987, abandoned, which is a continuation-in-part of Ser. No. 736,696, May 22, 1985, abandoned.

[51] Int. Cl.[4] ..... C22C 1/04

[52] U.S. Cl. ..... 75/0.5 AA; 75/0.5 BA; 420/435; 148/101

[58] Field of Search ..... 148/101, 301; 75/0.5 AA, 0.5 BA; 420/435

[56] References Cited

U.S. PATENT DOCUMENTS

| | | | |
|---|---|---|---|
| 3,919,001 | 11/1975 | Ratnam | 420/435 |
| 3,928,089 | 12/1975 | Cech | 148/301 |
| 4,090,892 | 5/1978 | Klein et al. | 420/435 |
| 4,144,105 | 3/1979 | Gaiffi et al. | 420/435 |
| 4,382,061 | 5/1983 | Herget et al. | 420/435 |
| 4,664,723 | 5/1987 | Ishii et al. | 148/301 |
| 4,689,073 | 8/1987 | Nate et al. | 75/0.5 BA |

FOREIGN PATENT DOCUMENTS

| | | | |
|---|---|---|---|
| 55-24911 | 2/1980 | Japan | 420/435 |
| 60-106930 | 6/1985 | Japan | 75/0.5 BA |

*Primary Examiner*—John P. Sheehan

*Attorney, Agent, or Firm*—Watson, Cole, Grindle & Watson

[57] ABSTRACT

A rare earth element-cobalt ($RCo_5$) type magnetic powder suitable for the manufacture of a resinous magnet is produced by a method comprising the steps of mixing the oxides of the rare earth elements consisting of Sm, a first member comprising at least one element selected from between La and Ce, and a second member comprising at least one element selected from between Pr and Nd with a reducing agent and cobalt powder, heating the resulting mixture in the normal-pressure atmosphere of an inert gas to a temperature in the range of 900° to 1,100° C., then elevating the temperature of the mixture to a level in the range of 1,150° to 1,200° C., subsequently cooling the heated mixture to 800° C. at a temperature decreasing rate in the range of 1° to 5° C./minute, lowering the temperature from 800° C. to 700° C. at a temperature decreasing rate of not less than 10° C./minute, cooling the mixture further to a level in the range of 400° to 200° C., then retaining the mixture at the level for a period in the range of 1 to 10 hours, subsequently cooling the mixture to normal room temperature, placing the resulting product of heat treatment in water thereby converting the product into a slurry, and treating the slurry with water and an aqueous acid solution. The magnetic powder is characterized by comprising (1) 33 to 35.5% by weight of rare earth elements consisting of 1.5 to 5% by weight of the first member, 0.3 to 8% by weight of the second member, and the balance of Sm and (2) the balance substantially of cobalt, respectively based on the total amount of the produced powders and possessing an average particle diameter in the range of 5 to 10 μm.

1 Claim, No Drawings

METHOD OF FORMING A RARE EARTH-COBALT TYPE MAGNETIC POWDER FOR RESINOUS MAGNET

RELATED APPLICATION

This application is a division of application Ser. No. 016,887, filed Feb. 20, 1987, now abandoned which in turn is a continuation in part of U.S. application Ser. No. 736,696 filed on May 22, 1985 now abandoned.

BACKGROUND OF THE INVENTION

1. Field of the Invention

This invention relates to a rare earth-cobalt, $RCo_5$ (R for rare earth elements and Co for cobalt) type magnetic powder suitable for a resinous magnet, which is produced by subjecting the oxides of the rare earth elements consisting of Sm as a main component and further of a first member comprising at least one element selected from between La and Ce and a second member comprising at least one element selected from between Pr and Nd, to the so-called reduction diffusion method, i.e. a procedure comprising the steps of first reducing the oxides with a reducing agent and diffusing the product of reduction in the cobalt powder.

2. Description of the Prior Art

The reduction diffusion method for producing a $SmCo_5$ type magnetic powder has been proposed in the specification of Japanese patent application disclosure No. SHO 54(1979)-102,271, which method effects the production by mixing the oxide of Sm with a reducing agent such as metallic calcium and cobalt powder, heating the resulting mixture as held in a container in the normal-pressure atmosphere of an inert gas at a temperature in the range.of 900° to 1,100° C., placing the resulting product of reaction in water thereby converting the product into a slurry, and treating this slurry with water and an aqueous acid solution. For use in the production of a sintered magnet by the steps of fine comminution, press forming, and thermal treatment, the magnetic powder obtained by the method just described proves to be more favorable in terms of magnetic property, cost, etc. than any of the magnetic powders obtained by the conventional electrolytic method and melting method. When this magnetic powder is used for the production of a resinous magnet, however, since the step of heat treatment involved in the production of the sintered magnet mentioned above cannot be performed after the magnetic powder is mixed with resin, the resinous magnet to be produced has very poor magnetic property and cannot fully manifest the advantage in terms of cost which would otherwise be brought about by the reduction diffusion method.

Moreover, generally in the manufacture of magnetic powder for use in the production of a resinous magnet, the desirability of realizing usability of the oxide of Sm of poor purity as the raw material for the purpose of lowering the cost of production has been finding growing recognition. The oxide of Sm having a low purity, however, contains La, Ce, Pr, and Nd as main impurities in addition to Sm as the principal metallic component of the oxide. The resinous magnet manufactured by the aforementioned reduction diffusion method using the oxide of Sm containing such defiling rare earth elements possesses an appreciably low magnetic property as compared with the resinous magnet manufactured using the oxide of Sm of high purity.

SUMMARY OF THE INVENTION

In view of the true status of affairs mentioned above, the inventors made a diligent study in search of a way of obtaining a $SmCo_5$ type magnetic powder suitable for the production of a resinous magnet by the reduction diffusion method as inexpensively as possible. They have consequently found that the magnetic powder aimed at can be obtained by limiting the contents of La, Ce, Pr, and Nd to be present, besides Sm as the principal element, in the oxides of rare earth elements and also limiting the conditions under which the reaction product resulting from reduction and diffusion is subjected to a heat treatment. This invention has been perfected as the result.

To be specific, this invention is directed to a rare earth-cobalt type magnetic powder for a resinous magnet, obtained by a method comprising the steps of mixing the oxides of the rare earth elements consisting of Sm, a first member comprising at least one element selected from between La and Ce, and a second member comprising at least one element selected from between Pr and Nd with a reducing agent and cobalt powder, heating the resulting mixture in the normal-pressure atmosphere of an inert gas to a temperature in the range of 900° to 1,100° C., then elevating the temperature of the mixture to a level in the range of 1,150° to 1,200° C., subsequently cooling the heated mixture to 800° C. at a temperature decreasing rate in the range of 1° to 5° C./minute, lowering the temperature from 800° C. to 700° C. at a temperature decreasing rate of not less than 10° C./minute, cooling the mixture further to a level in the range of 400° to 200° C., then retaining the mixture at the level for a period in the range of 1 to 10 hours, subsequently cooling the mixture to normal room temperature, placing the resulting product of heat treatment in water thereby converting the product into a slurry, and treating the slurry with water and an aqueous acid solution, which magnetic powder is characterized by comprising (1) 33 to 35.5% by weight of rare earth elements consisting of 1.5 to 5% by weight of the first member, 0.3 to 8% by weight of the second member, and the balance of Sm and (2) the balance substantially of cobalt, respectively based on the total amount of the produced powders and possessing an average particle diameter in the range of 5 to 10 $\mu$m.

DETAILED DESCRIPTION OF THE INVENTION

In accordance with this invention, the oxides of the rare earth elements consisting of Sm, a first member comprising at least one element selected from between La and Ce, and a second member comprising at least one element selected from between Pr and Nd are mixed with a reducing agent such as, for example, calcium or magnesium and cobalt powder and the resultant mixture is heated as placed in a container in the normal-pressure atmosphere of an inert gas such as, for example, argon or helium at a temperature in the range of 900° to 1,100° C. In this case, the amounts of the rare earth elements and cobalt to be contained in the mixture must be limited so that the magnetic powder to be obtained by the method of this invention will comprise (1) 33 to 35.5% by weight of rare earth elements consisting of 1.5 to 5% by weight of the first member, 0.3 to 8% by weight of the second member, and the balance of Sm and (2) the balance substantially of cobalt, respectively based on the total amount of raw material powders.

Concerning the rare earth elements contained in the aforementioned oxides of rare earth elements, if the content of La and/or Ce is less than 1.5% by weight or the content of Pr and/or Nd is less than 0.3% by weight, the magnetic powder possessing the same magnetic property as imparted by the heat treatment contemplated by the present invention can be obtained even when the reaction product obtained by reduction and diffusion of the mixture is not subjected to the aforementioned heat treatment, namely when the magnetic powder is produced by a method of the kind disclosed in the aforementioned patent application disclosure No. SHO 54(1979)-102,271 or U.S. Pat. Ser. No. 796,224 filed on Nov. 8, 1985 now U.S. Pat. No. 4,664,723. Conversely, if the content of La and/or Ce exceeds 5% by weight or the content of Pr and/or Nd exceeds 8% by weight, the effect to be brought about by the heat treatment contemplated by the present invention is not sufficient.

If the total content of the rare earth elements consisting of La and/or Ce, Pr and/or Nd, and Sm falls below 33% by weight, the coercive force of the produced magnetic powder is sharply lowered. Conversely, if the total content rises beyond 35.5% by weight, the residual flux density of the produced magnetic powder is sharply lowered.

After the mixture is heated to a temperature in the range of 900° to 1,100° C., the temperature of the heated mixture is elevated to a level in the range of 1,150° to 1,200° C. This temperature elevation is carried out for the purpose of uniformizing the structure of the reaction product obtained by the heating to the temperature in the range of 900° to 1,100° C. If the elevated temperature is lower than 1,150° C., the diffusion proceeds slowly and the uniformization consumes an unduly long time. If it exceeds 1,200° C., the product of reaction is partially fused to the extent of entailing a phenomenon of sintering the rare earth elements (hereinafter occasionally referred to as "R") are volatilized to the extent of causing an alteration of the composition. Thus, the temperature elevation must be carried out to a level falling in the range of 1,150° to 1,200° C.

Then, the uniformized product of reaction is cooled from the elevated temperature mentioned above to 800° C. at a temperature decreasing rate in the range of 1° to 5° C./minute. This cooling treatment is carried out for the purpose of inducing separation of $R_2Co_7$ phase, $R_2Co_{17}$ phase, etc. from the uniformized texture obtained by the preceding treatment and purifying the remaining $RCo_5$ phase to the fullest possible extent. If this temperature decreasing rate is less than 1° C./minute, the cooling treatment consumes an unduly long time. If this rate exceeds 5° C./minute, the cooling fails to induce sufficient separation of the $R_2Co_7$ phase, the $R_2Co_{17}$ phase, etc. and the produced magnetic powder, therefore, does not acquire a satisfactory magnetic property. Thus, the cooling treatment must be carried out at a temperature decreasing rate in the range of 1° to 5° C./minute.

Subsequently, the cooled product is further cooled from 800° C. to 700° C. at a temperature decreasing rate of not less than 10° C./minute. This treatment is carried out for the purpose of inhibiting to the fullest possible extent the reaction which the $R_2Co_7$ phase and the $R_2Co_{17}$ phase are formed from the $RCo_5$ phase. If this temperature decreasing rate falls below 10° C./minute, the object of this treatment is not sufficiently fulfilled and, despite an increase of the residual flux density, the coercive force is sharply lowered. Thus, this treatment must be carried out at a temperature decreasing rate of not less than 10° C./minute.

Thereafter, the product is cooled to a level in the range of 400° to 200° C. and retained at this level for a period in the range of 1 to 10 hours. This treatment is carried out for the purpose of the product of heat treatment of the thermal strain conferred thereon by the heat treatment carried out so far. It must be carried out for 1 to 10 hours' period.

Now, the resulting product of heat treatment is placed in water to be converted into a slurry and this slurry is treated with water and an aqueousacid solution such as, for example, dilute acetic acid. This treatment may be carried out by the conventional method.

Further, the powder consequently obtained is subjected to adjustment of grain size so as to acquire an average particle diameter in the range of 5 to 10 μm. This treatment is generally carried out by means of mechanical comminution. When the cobalt powder selected as one of the components of the starting mixture has a grain size such that the produced powder will automatically acquire an average particle diameter in the range of 5 to 10 μm, this treatment of size adjustment may be omitted.

This treatment for grain size adjustment is necessary because the residual flux dnesity is unduly lowered if the average particle diameter is less than 5 μm and the coercive force is unduly lowered if the average particle diameter exceeds 10 μm.

The $RCo_5$ type magnetic powder produced as described above, when put to use for the production of a resinous agent, permits the produced resinous magnet to acquire notably improved magnetic property.

Now, the present invention will be described more specifically below with reference to a working example.

EXAMPLE $Sm_2O_3$, $La_2O_3$, $CeO_2$, $Pr_6O_{11}$, and $Nd_2O_3$ were prepared as oxides of rate earth elements and were mixed with Co powder and Ca particles in proportions calculated so as to form a prescribed composition. The resultant mixture was packed in a pot made of stainless steel.

This pot was set in position in a reaction vessel. The reaction vessel was evacuated and the mixture inside was swept with Ar gas supplied under normal pressure. The reaction vessel was heated and kept at 980° C. for one hour, further heated to 1,170° C., and kept this temperature for three hours. Then, the hot mixture was cooled to 800° C. at a temperature decreasing rate of 2° to 3° C./minute. The pot still kept tightly closed was removed from the reaction vessel and left cooling in a draft at a temperature decreasing rate of 14° to 20° C./minute from 800° C. to 700° C. The flow of the draft was stopped. Then, the pot was left cooling spontaneously to 300° C. It was again set in position in the reaction vessel, kept at 300° C. for three hours, and then cooled to normal room temperature.

The product of the heat treatment was treated with water and dilute acetic acid of about pH 2.5 for expulsion of CaO and unaltered Ca from the product.

The powder consequently obtained was washed with alcohol for removal of adhering water by displacement and then dried.

The composition of the powder finally obtained was as shown in Table 1.

In a rotary ball mill, the produced powder was pulverized as covered fully with ethyl alcohol for two hours. The fine powder obtained by this pulverization had an average particle diameter shown in Table 1.

Separately, mixtures prepared in the compositions shown in Run Nos. 35, 36, 37, and 38 in Table 1 were treated by faithfully following the procedure described above, excepting they were kept at 980° C. for one hour and then cooled to room temperature. The magnetic powders prepared as described above were severally kneaded with polyamide resin (nylon 6) added thereto in an extrapolative ratio of 8.5% by weight. The resultant blends were pelletized and injection molded in a magnetic field of 15 kOe.

The resinous magnets consequently obtained were tested for magnetic properties. The results were as shown in Table 2.

As described above, this invention produces a $RCo_5$ type magnetic powder suitable for the manufacture of a resinous magnet excelling in magnetic properties such as residual flux density, coercive force, and maximum energy product.

While the present invention has been described by means of a specific embodiment, it is to be understood that numerous changes and modifications may be made therein without departing from the spirit and scope of the invention as defined in the appended claim.

TABLE 2

| | Run No. | Residual flux density Br (KG) | Coercive force $B^HC$ (KOe) | Maximum energy product $(BH)_{max}$ (MGOe) |
|---|---|---|---|---|
| Example | 1 | 6.47 | 4.10 | 9.00 |
| " | 2 | 6.30 | 4.07 | 8.90 |
| " | 3 | 6.30 | 4.67 | 9.25 |
| " | 4 | 6.50 | 4.27 | 9.05 |
| " | 5 | 6.47 | 4.47 | 9.25 |
| "6 | 6.55 | 4.45 | 9.40 | |
| " | 7 | 6.50 | 4.40 | 9.30 |
| " | 8 | 6.25 | 4.50 | 9.00 |
| " | 9 | 6.50 | 4.35 | 9.10 |
| " | 10 | 6.60 | 4.50 | 9.50 |
| " | 11 | 6.40 | 4.40 | 9.20 |
| " | 12 | 6.33 | 4.23 | 9.00 |
| " | 13 | 6.85 | 3.80 | 8.80 |
| " | 14 | 6.25 | 4.55 | 9.17 |
| " | 15 | 6.45 | 4.35 | 9.10 |
| " | 16 | 6.45 | 4.40 | 9.15 |
| " | 17 | 6.10 | 4.20 | 8.65 |
| " | 18 | 6.10 | 4.75 | 9.00 |
| " | 19 | 6.30 | 4.00 | 8.87 |
| " | 20 | 6.20 | 4.10 | 8.85 |
| " | 21 | 6.27 | 4.40 | 9.10 |
| " | 22 | 6.50 | 4.30 | 9.20 |
| " | 23 | 6.70 | 4.70 | 9.95 |
| " | 24 | 6.65 | 4.05 | 9.27 |
| Comparative Experiment | 25 | 6.00 | 3.85 | 8.40 |
| " | 26 | 6.05 | 4.00 | 8.55 |
| " | 27 | 6.05 | 3.90 | 8.50 |
| " | 28 | 6.05 | 3.70 | 8.37 |

TABLE 1

| | Run No. | Rare earth element (% by weight) La | Ce | La + Ce (1) | Pr | Nd | Pr + Nd (2) | Sm (3) | Total amount (% by weight) (1) + (2) + (3) | Ca (% by weight) | Co (% by weight) | Average particle diameter (μm) |
|---|---|---|---|---|---|---|---|---|---|---|---|---|
| Example | 1 | 1.6 | — | 1.6 | 2.7 | 2.4 | 5.1 | 27.2 | 33.9 | 0.12 | Balance | 7.5 |
| " | 2 | — | 1.7 | 1.7 | 2.3 | 2.7 | 5.0 | 27.2 | 33.9 | 0.08 | " | 8.3 |
| " | 3 | 2.7 | — | 2.7 | — | 3.1 | 3.1 | 28.1 | 33.9 | 0.12 | " | 9.0 |
| " | 4 | 2.9 | — | 2.9 | 3.0 | 2.7 | 5.7 | 25.3 | 33.9 | 0.10 | " | 7.5 |
| " | 5 | — | 2.9 | 2.9 | 3.2 | 2.6 | 5.8 | 25.3 | 34.0 | 0.13 | " | 7.7 |
| " | 6 | 3.0 | — | 3.0 | 3.0 | — | 3.0 | 28.1 | 34.1 | 0.13 | " | 8.4 |
| " | 7 | — | 3.0 | 3.0 | 2.9 | — | 2.9 | 28.0 | 33.9 | 0.09 | " | 8.1 |
| " | 8 | — | 3.1 | 3.1 | — | 3.0 | 3.0 | 27.9 | 34.0 | 0.12 | " | 8.2 |
| " | 9 | 1.6 | 1.6 | 3.2 | 2.5 | 2.3 | 4.8 | 25.9 | 33.9 | 0.10 | " | 8.3 |
| " | 10 | 1.7 | 1.6 | 3.3 | 0.5 | 0.4 | 0.9 | 29.8 | 34.0 | 0.09 | " | 7.1 |
| " | 11 | 2.3 | 2.2 | 4.5 | 4.1 | 3.6 | 7.7 | 21.7 | 33.9 | 0.11 | " | 8.7 |
| " | 12 | 2.0 | 2.5 | 4.5 | 3.5 | 4.0 | 7.5 | 22.3 | 34.3 | 0.16 | " | 6.7 |
| " | 13 | 2.3 | 2.3 | 4.6 | 4.0 | 3.9 | 7.9 | 20.9 | 33.4 | 0.13 | " | 9.2 |
| " | 14 | 2.3 | 2.4 | 4.7 | 0.4 | — | 0.4 | 28.8 | 33.9 | 0.10 | " | 6.5 |
| " | 15 | 2.3 | 2.5 | 4.8 | 2.9 | 3.0 | 5.9 | 23.3 | 34.0 | 0.15 | " | 8.0 |
| " | 16 | 2.3 | 2.5 | 4.8 | — | 3.3 | 3.3 | 25.9 | 34.0 | 0.10 | " | 7.6 |
| " | 17 | 2.5 | 2.3 | 4.8 | 2.5 | 2.3 | 4.8 | 24.3 | 33.9 | 0.15 | " | 8.2 |
| " | 18 | 2.5 | 2.3 | 4.8 | 4.2 | 3.6 | 7.8 | 22.5 | 35.1 | 0.14 | " | 8.6 |
| " | 19 | 4.9 | — | 4.9 | 2.5 | 2.3 | 4.8 | 24.3 | 34.0 | 0.14 | " | 7.5 |
| " | 20 | — | 4.9 | 4.9 | 2.4 | 2.5 | 4.9 | 24.2 | 34.0 | 0.09 | " | 9.1 |
| Example | 21 | 2.5 | 2.4 | 4.9 | — | 0.4 | 0.4 | 28.6 | 33.9 | 0.09 | Balance | 6.7 |
| " | 22 | 2.5 | 2.5 | 5.0 | 3.0 | — | 3.0 | 25.9 | 33.9 | 0.14 | " | 8.1 |
| " | 23 | 2.5 | 2.5 | 5.0 | 7.6 | — | 7.6 | 21.4 | 34.0 | 0.12 | " | 7.0 |
| " | 24 | 2.5 | 2.5 | 5.0 | — | 7.7 | 7.7 | 21.3 | 34.0 | 0.11 | " | 8.3 |
| Comparative Experiment | 25 | — | 1.1 | 1.1 | 4.9 | — | 4.9 | 28.1 | 34.1 | 0.11 | " | 6.6 |
| " | 26 | 1.2 | — | 1.2 | 4.9 | — | 4.9 | 28.0 | 34.1 | 0.09 | " | 9.1 |
| " | 27 | 1.2 | — | 1.2 | — | 5.0 | 5.0 | 27.9 | 34.1 | 0.10 | " | 8.7 |
| " | 28 | — | 1.2 | 1.2 | — | 4.8 | 4.8 | 28.0 | 34.0 | 0.10 | " | 8.4 |
| " | 29 | — | 3.5 | 3.5 | 9.0 | — | 9.0 | 21.6 | 34.1 | 0.11 | " | 7.6 |
| " | 30 | 3.5 | — | 3.5 | — | 9.0 | 9.0 | 21.4 | 33.9 | 0.10 | " | 7.5 |
| " | 31 | 2.0 | 2.5 | 4.5 | 5.0 | — | 5.0 | 23.5 | 33.0 | 0.12 | " | 6.5 |
| " | 32 | 2.3 | 2.3 | 4.6 | 6.5 | — | 6.5 | 24.9 | 36.0 | 0.12 | " | 9.2 |
| " | 33 | — | 5.8 | 5.8 | 2.5 | — | 2.5 | 25.6 | 33.9 | 0.11 | " | 8.1 |
| " | 34 | 5.9 | — | 5.9 | 3.0 | — | 3.0 | 25.1 | 34.0 | 0.12 | " | 8.3 |
| " | 35 | 2.8 | — | 2.8 | 3.0 | — | 3.0 | 28.2 | 34.0 | 0.15 | " | 8.1 |
| " | 36 | 5.0 | — | 5.0 | 2.5 | 2.3 | 4.8 | 24.1 | 33.9 | 0.10 | " | 9.3 |
| " | 37 | 1.7 | 1.6 | 3.3 | 1.0 | 0.5 | 1.5 | 29.0 | 33.8 | 0.09 | " | 7.7 |
| " | 38 | 2.2 | 2.2 | 4.4 | 4.0 | 3.5 | 7.5 | 21.7 | 33.6 | 0.12 | " | 7.2 |

TABLE 2-continued

| | Run No. | Residual flux density Br (KG) | Coercive force $B^{H}C$ (KOe) | Maximum energy product $(BH)_{max}$ (MGOe) |
|---|---|---|---|---|
| " | 29 | 6.90 | 3.35 | 8.27 |
| Comparative Experiment | 30 | 6.77 | 3.10 | 8.10 |
| " | 31 | 6.65 | 3.80 | 8.50 |
| " | 32 | 6.00 | 4.25 | 8.45 |
| " | 33 | 6.60 | 3.60 | 8.50 |
| " | 34 | 6.55 | 3.75 | 8.47 |
| " | 35 | 5.65 | 4.00 | 7.10 |
| " | 36 | 5.50 | 3.95 | 7.00 |
| " | 37 | 6.05 | 3.30 | 6.95 |
| " | 38 | 5.35 | 3.90 | 6.70 |

What is claimed is:

1. A method of forming an $RCo_5$ rare earth-cobalt magnetic powder for a resinous magnet which comprises (1) 33 to 35.5% by weight of rare earth elements consisting of 1.5 to 5% by weight of at least one of La and Ce, 0.3 to 8% by weight of at least one of Pr and Nd and a balance of Sm, and (2) a balance substantially of cobalt, respectively based on the total amount of the produced powders and possessing an average particle diameter in the range of 5 to 10 μm, said method comprising the steps of mixing oxides of the rare earth elements consisting of Sm, a first member comprising at least one element selected from between La and Ce, and a second member comprising at least one element selected from between Pr and Nd with a reducing agent and cobalt powder, heating the resulting mixture in a normal-pressure atmosphere of an inert gas to a temperature in the range of 900° to 1,000° C., then elevating the temperature of said mixture to a level in the range of 1,150° to 1,200° C., subsequently cooling the heated mixture to 800° C. at a temperature decreasing rate in the range of 1° to 5° C./minute, lowering the temperature from 800° C. to 700° C. at a temperature decreasing rate of not less than 10° C./minute, cooling the mixture further to a level in the range of 400° to 200° C., then retaining the mixture at said level for a period in the range of 1 to 10 hours, subsequently cooling said mixture to normal room temperature, placing the resulting product of heat treatment in water, thereby converting said product into a slurry, and treating said slurry with water and aqueous acid solution.

* * * * *

UNITED STATES PATENT AND TRADEMARK OFFICE

CERTIFICATE OF CORRECTION

PATENT NO. : 4,863,511

DATED : September 5, 1989

INVENTOR(S) : Junichi Ishii et al.

It is certified that error appears in the above-identified patent and that said Letters Patent is hereby corrected as shown below:

On the title page insert

--[30] Foreign Application Priority Data

May 22, 1984 Japan ..... 101726/59--.

Signed and Sealed this

Twenty-fourth Day of July, 1990

*Attest:*

HARRY F. MANBECK, JR.

*Attesting Officer*

*Commissioner of Patents and Trademarks*